US005672103A

United States Patent [19]

Jardinier

[11] Patent Number: 5,672,103

[45] Date of Patent: Sep. 30, 1997

[54] METHOD AND DEVICE FOR FEEDING THE VARIOUS ROOMS OF PREMISES WITH VENTILATION AIR

[75] Inventor: Pierre C. J. Jardinier, Gournay sur Marne, France

[73] Assignee: Conseils Etudes et Recherches en Gestion de l'Air (C.E.R.G.A.), Bussy Saint Georges, France

[21] Appl. No.: 288,206

[22] Filed: Aug. 9, 1994

[30] Foreign Application Priority Data

Aug. 10, 1993 [FR] France ..... 93 09997

[51] Int. Cl.[6] ..... F24F 11/047

[52] U.S. Cl. ..... 454/256; 55/352

[58] Field of Search ..... 454/255, 256, 454/229; 55/290, 352

[56] References Cited

U.S. PATENT DOCUMENTS

| | | | |
|---|---|---|---|
| 4,487,363 | 12/1984 | Parker et al. . | |
| 5,228,306 | 7/1993 | Shyu et al. | 454/256 X |
| 5,234,481 | 8/1993 | Jardinier et al. | 55/352 X |

FOREIGN PATENT DOCUMENTS

| | | | |
|---|---|---|---|
| 292040 | 12/1986 | Japan | 454/256 |
| 263345 | 10/1988 | Japan | 454/256 |
| 184313 | 7/1990 | Japan | 55/352 |
| 183856 | 5/1963 | Sweden | 454/255 |

*Primary Examiner*—Harold Joyce
*Attorney, Agent, or Firm*—Oliff & Berridge

[57] ABSTRACT

This method consists in supplying the various rooms of the premises with air under stable low pressure using a relatively high-pressure fan, in feeding the fan, on the one hand, using fresh air, and, on the other hand, using recycled air, that is to say air that has been displaced by the fan and not let into the premises, and in regulating the respective proportions of fresh air and recycled air so that the proportion of fresh air increases and the proportion of recycled air decreases when the ventilation requirements increase, and so that the proportion of fresh air decreases and the proportion of recycled air increases when the ventilation requirements decrease, so that the delivery rate of the fan is kept almost constant.

Application to systems for controlled mechanical ventilation of premises.

14 Claims, 2 Drawing Sheets

METHOD AND DEVICE FOR FEEDING THE VARIOUS ROOMS OF PREMISES WITH VENTILATION AIR

The subject of the present invention is a method and a device for feeding the various rooms of presses with ventilation air.

BACKGROUND OF THE INVENTION

It is known that the various rooms of premises, such as an apartment, have variable ventilation requirements, depending on their occupation by persons and depending on the conditions of their use.

These requirements change with cycles which are not predictable and which may be very different from one apartment to another, or even from one room to another in the same apartment, or, for one and the same room, vary during the length of occupation of the apartment.

There are various techniques for ventilating premises.

The first technique consists in carrying out mechanical extraction at fixed flow rate in the technically designed rooms, with passive air inlets in the main rooms.

A second technique consists in carrying out mechanical extraction in the technically designed rooms, slaved to a requirement in the technically designed rooms, with passive air inlets which may or may not be slaved in the main rooms.

A third technique consists in carrying out double-flow ventilation, consisting in single mechanical extraction in the technically designed rooms and single blowing into the main rooms, the extraction and blowing being carried out with equal flow rates.

The first and third solutions concern ventilation systems with fixed flow rates which are of little relevance to the requirement for variable flow rates which currently exists.

The second solution has the advantage of slaving the ventilation to a requirement expressed in the technically designed rooms, insofar as the extraction is slaved, and in the main rooms insofar as the air inlets are slaved.

However, the main defect of this latter technique is that it only varies the cross section of the air inlets and does not vary the actual flow rate into the rooms where they are installed. In fact, the flow rate passing through the main rooms is the same as that which is extracted mechanically from the technically designed rooms. The total flow rate extracted is distributed in proportion to the open areas on the outside of each room. The flow rate passing through these rooms therefore results from the relative opening cross section of the air inlets, but also from possible leaks from the apartment which are distributed randomly and upset correct operation of the whole.

It should be noted that apartments are frequently encountered in which the parasitic leaks are equivalent to the maximum opening cross section of the air inlets. These leaks are highly problematic for the lowest flow rates because the air distribution of the extracted flow rate is no longer provided as a function of the air inlet cross sections but as a function of the air inlet cross sections plus the leaks.

Similarly, if a window is open in a room, for example, essentially all the extracted flow rate comes from this room, and the other rooms, even if they have higher ventilation requirements, are little ventilated or poorly ventilated.

It should also be borne in mind that it is not possible to define a mean value of the leaks from apartments over a large number of apartments, which prevents consideration of a stable pressure on either side of the air inlet. Moreover, it is this pressure which generates the flow rate through the passage cross section.

Furthermore, the technique of natural air inlets does not allow very effective measures to be taken against outside noise, because of the head loss to which acoustic absorption devices in general lead.

Finally, it is impossible to interpose an efficient filter, intended to capture dust or the like, between the outside and the inside of the house, because such a filter requires an operating pressure which is incompatible with the normal values in natural passage.

SUMMARY OF THE INVENTION

The object of the invention is to provide a device which ensures stability of the pressure of the air let into the various rooms of premises, independently of the random leaks of these premises, whatever the flow rate required in each of the main rooms, and whatever the outside conditions such as wind or temperature.

A further object of the invention is to make it possible to filter the air let into the premises and, optionally, preheat it.

DESCRIPTION OF THE PREFERRED EMBODIMENTS

For this purpose, the method to which it relates consists in supplying the various rooms of the premises with air under stable low pressure using a relatively high-pressure fan, in feeding the fan, on the one hand, using fresh air, and, on the other hand, using recycled air, that is to say air that has been displaced by the fan and not let into the premises, and in regulating the respective proportions of fresh air and recycled air so that the proportion of fresh air increases and the proportion of recycled air decreases when the ventilation requirements increase, and so that the proportion of fresh air decreases and the proportion of recycled air increases when the ventilation requirements decrease, so that the delivery rate of the fan remains relatively constant.

The stable low pressure is obtained by variable internal recycling on a fan working at substantially fixed flow rate and pressure (this pressure lying between 80 and 180 Pa), the fixed low pressure for distribution into the rooms of the premises lying between 5 and 40 Pa.

According to one embodiment, this method consists in varying, simultaneously and in the opposite sense, the valve cross sections arranged on an intake opening for fresh air to the fan and on a pipe for recycling the air.

Advantageously, this method consists in regulating the proportions of fresh air and recycled air by monitoring the difference in the pressures prevailing respectively upstream of the fan in a region subjected to the influences of the recycled air and of the fresh air, and downstream of the fan in a region located upstream of the pipes for feeding the various rooms of the premises with air.

The cross sections of the valves arranged on the intake opening for fresh air to the fan and on the air recycling pipe vary simultaneously and in the opposite sense in order to increase or decrease the flow rate of fresh air and to decrease or increase the flow rate of recycled air while maintaining a fixed total flow rate.

According to one possibility, the difference in the pressures upstream of the fan and upstream of the pipes for feeding the various rooms is defined with respect to a reference pressure. The proportions chosen are fixed and not variable.

This reference pressure is obtained by mixing the pressures, respectively, of the fresh air outside the premises and of the air inside the premises.

According to one possibility, the reference pressure is obtained by mixing from 0.5 to 0.15 times the pressure of the fresh air and from 0.5 to 0.85 times the pressure of the air inside the premises. The proportions chosen are fixed and not variable.

The pressure difference may be read periodically, given that it is not necessary to adjust the pressures continuously for use in ventilation, the variations in requirements of the main rooms being always fairly slow.

In addition, it is possible to alter the setting only when several successive measurements give the same information, in order to avoid false measurements which can result from external influences such as gusts of wind, slamming doors or the like.

According to another feature, this method consists in arranging head-loss elements upstream and downstream of the fan in order to obtain balanced pressures at the fan and to lower the pressure of the air supplied to the pipes for feeding the rooms of the premises, with respect to the pressure supplied by the fan.

This makes it possible, although using a fan operating at a relatively high pressure, to provide a low-pressure supply to the rooms of the premises to be ventilated, which increases comfort by, in particular, limiting noise. Thus, it is possible to create two compartments on either side of the fan, in which the pressure will be at an intermediate value, for example 30%, 50% or 70% of the total pressure of the fan.

A device for implementing this method comprises an enclosure having a fresh air inlet pipe communicating with the outside and equipped with a valve, and air outlet ducts connected to the pipes for feeding the premises with air, this enclosure being equipped with a fan, and with a recycling pipe which, returning a portion of the air from the region including the outlet ducts to the region including the fresh air inlet, is fitted with a regulating valve whose cross section is actuated in synchronism and in the opposite sense to the fresh air inlet valve, while keeping the flow rate supplied to the fan constant.

In addition, two chambers are made upstream and downstream of the fan, the one arranged upstream being bounded by a filter and the one arranged downstream being bounded by a cross section reduction generating substantially the same head loss as the filter.

Advantageously, in order to balance the pressures upstream and downstream of the fan, the cross section reducer element placed downstream of the filter has a cross section equal to the equivalent cross section of the filter when clean, less half the equivalent cross section variation of the filter during clogging.

According to one possibility, the filter is a winding filter, the replenishment movement of which is triggered by the exceeding of a defined difference between the relative pressures ($P_i$–$P_2$) and ($P_3$–$P_i$) prevailing immediately upstream and downstream of the fan.

According to one embodiment of this device, the valves located on the fresh air inlet and in the recycling pipe consist of a single valve in the form of a three-way mixer valve.

DESCRIPTION OF THE DRAWINGS

In any case, the invention will be clearly explained with the aid of the following description, with reference to the attached schematic drawing which represents, by way of non-limiting examples, several embodiments of this device:

FIG. 1 represents a device comprising a main enclosure 2, in one wall of which an opening 3 is made which is equipped with an air inlet valve 4. The outside air is at the pressure Pe, and the opening 3 and the valve 4 define a passage SO.

Figure 1:
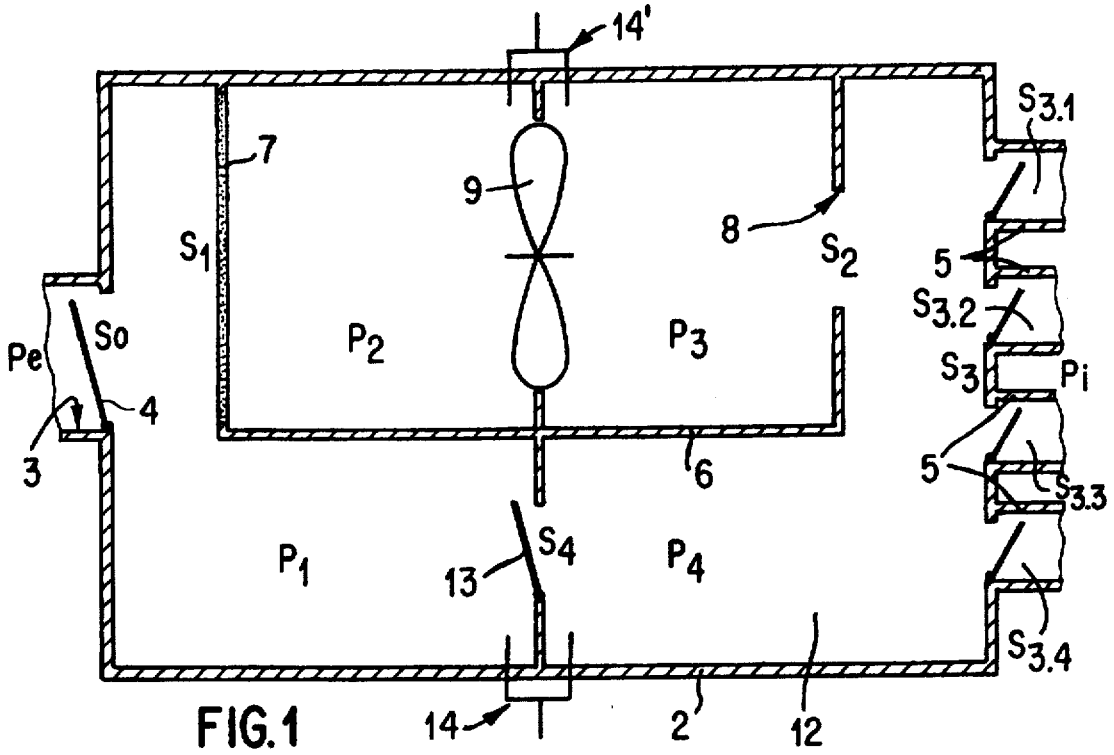
FIGS. 1 and 2 are two highly schematic views of two embodiments of this device.

In another wall of the enclosure 2, ducts 5 for connection to the pipes for feeding air to premises emerge. These ducts corresponding to an overall cross section S3 distributed, in this case, in four cross sections S3.1, S3.2, S3.3 and S3.4.

Inside the main enclosure 2 there is a smaller enclosure 6, whose end face located on the side of the inlet opening 3 is closed by a filter 7 corresponding to a passage cross section S1, and whose other end is equipped with an opening 8 of reduced cross section, corresponding to a passage cross section S2. A fan 9 is mounted in the middle of this enclosure 6 which it divides into two compartments.

This is a relatively high-pressure fan, from 100 to 200 Pa, the pressure/flow rate operating curve of which does not require a large plateau because the flow rate of the fan is kept substantially constant.

Between the enclosure 6 and the enclosure 2, a pipe 12 is made for recycling the air leaving the enclosure 6 back to its inlet. A recycling valve 13 providing a passage cross section S4 is mounted on this recycling pipe 12.

In operation, there will be a pressure P2 in the enclosure 6 upstream of the fan 9, P3 in the enclosure 6 downstream of the fan 9, P4 in the enclosure 2 on the side of the pipes for feeding air to the premises, and P1 on the side of the air inlet 3. A pressure Pi prevails inside the premises.

Using a device 14 which is not described in detail here, the difference between the pressures P4 and P1 is measured with comparison to a reference pressure which is defined on the basis of the pressures Pe and Pi. For example:

$$-P\ ref = A\ Pe + B\ Pi$$

where A lies between 0.5 and 0.15, and B lies between 0.5 and 0.85.

The device 14 acts on the valves 4 and 13 so as to close one when it opens the other, in a constant proportion in order to increase or decrease the flow rate of fresh air and to decrease or increase the flow rate of recycled air, while maintaining a fixed total flow rate.

The ventilation requirement of the premises is expressed by the cross section S3. When S3 varies, S0 is to vary so that the air leaving the enclosure to enter the rooms of the premises is replaced by outside air.

If S3 increases, this results in a fall in P4 and a slight fall in P1, due to a slight increase in the pressure reduction. An imbalance between P1 and P4 is produced and detected by the device 14.

The valve 4 is then opened to increase S0 by a preset quantity corresponding to an increment step, and the valve 13 is closed by the same step. If the imbalance remains on the following reading, the valve 4 is opened by a further step and the valve 13 is closed by a further step. When the equilibrium defined between the pressures P1 and P4 is again achieved, the valves remain in the state in which they are.

If the ventilation requirement falls in the rooms, S3 decreases and this results in an increase in P4 and a slight increase in P1 due to a slight fall in the pressure reduction. An imbalance is then produced between the pressures P1 and P4 in the opposite sense to the preceding case. This imbalance, detected by the device 14, leads to opening of the valve 13, increase in S4 and closure of the valve 4, decrease in S0.

The combined use of the interior pressure and the exterior pressure for obtaining the reference pressure for measuring the imbalance between P1 and P4 makes it possible to weight the pressure variations due, for example, to the wind, or to the switching on of auxiliary ventilation such as a cooker hood. The weighting referred to above makes it possible to minimize these external phenomena.

Another advantage of the invention is that it uses a fan 9 with high operating pressure, which makes it possible to combine with the device an efficient filter 7 for the air entering the apartment. It is, in particular, possible to filter out any pollen and trap a large proportion of the dust normally present in the air in urban or industrial areas.

The filtering device is placed upstream of the fan in order to protect the mechanical or air-treatment members.

The efficiency of the filtering is enhanced by the recycling principle. In fact, since the valve 13 is generally at least partly open, a proportion of the air which is blown in passes over the filter several times, so that it is already purified during its first passage.

When an apartment is little occupied, the ventilation requirement decreases, and the internal recycling of the air increases. In consequence, the air blown into the apartment when it is unoccupied is very clean and the filter clogs up slowly.

This method and this device also have the advantage of allowing good insulation of the premises with regard to outside noise. It is, in fact, possible to interpose a baffle between the fresh air intake which may be placed on a front which is exposed to little noise and the blowing in enclosure.

It is possible to have efficient acoustic absorption because of the localized treatment of the air, which is no longer distributed over each air inlet, and of the presence of the fan which makes it possible to combat the head loss inherent in an acoustic absorption device.

It is also possible to treat the air thermally inside the premises, in particular by heating the recycling air, or by passing it over a cold body without having to resort to excessively complex systems.

Figure 2:
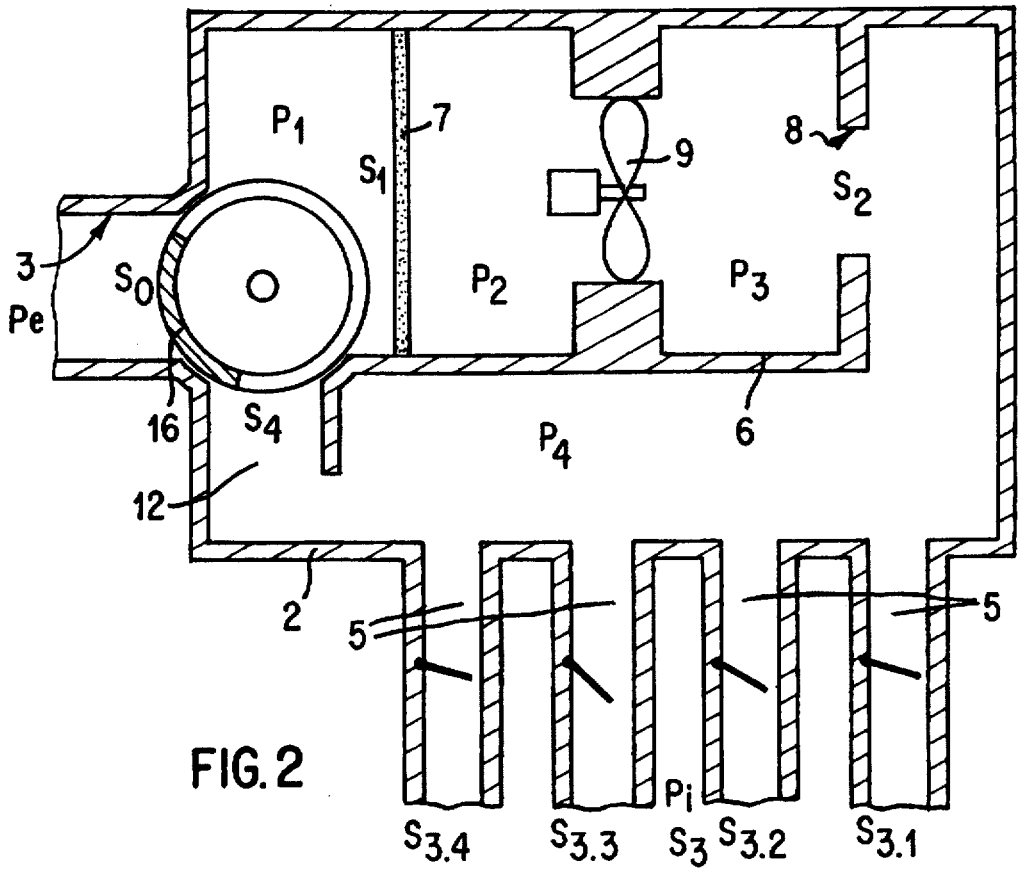

FIG. 2 shows a variant of the device in FIG. 1, in which the valves 4 and 13 have been combined into a single pivoting valve 16 which opens the cross section S0 of the inlet 3 when it decreases the cross section S4 of the pipe 12, and vice versa.

The cross section S2 of the opening 8 makes it possible to maintain the operating position of the fan 9 as the filter clogs up. S2 is chosen with respect to the head loss of the filter and its predicted change over time. When the filter is clean, it is S2 which constitutes the main head loss. The more the filter 7 clogs up, and the more its equivalent cross section S1 decreases, its head loss increasing progressively to outweigh S2.

This change is detected by means 14' (not described) for monitoring the pressures P2 and P3, which means make it possible to generate either a signal for warning of a clogged filter, or replenishment of the filter if the enclosure is equipped with a filter with automatic replenishing system.

As indicated above, the cross section S2 may be chosen to be equal to the equivalent cross section of the filter halfway through its lifetime.

The relatively high operating point of the fan and the presence of the head-loss elements S1 and S2 make it possible to have pressures P2 and P3 which are not negligible and close to each other in absolute value. P2 is a reduced pressure with respect to the reference pressure, while P3 is an overpressure.

Figure 3:
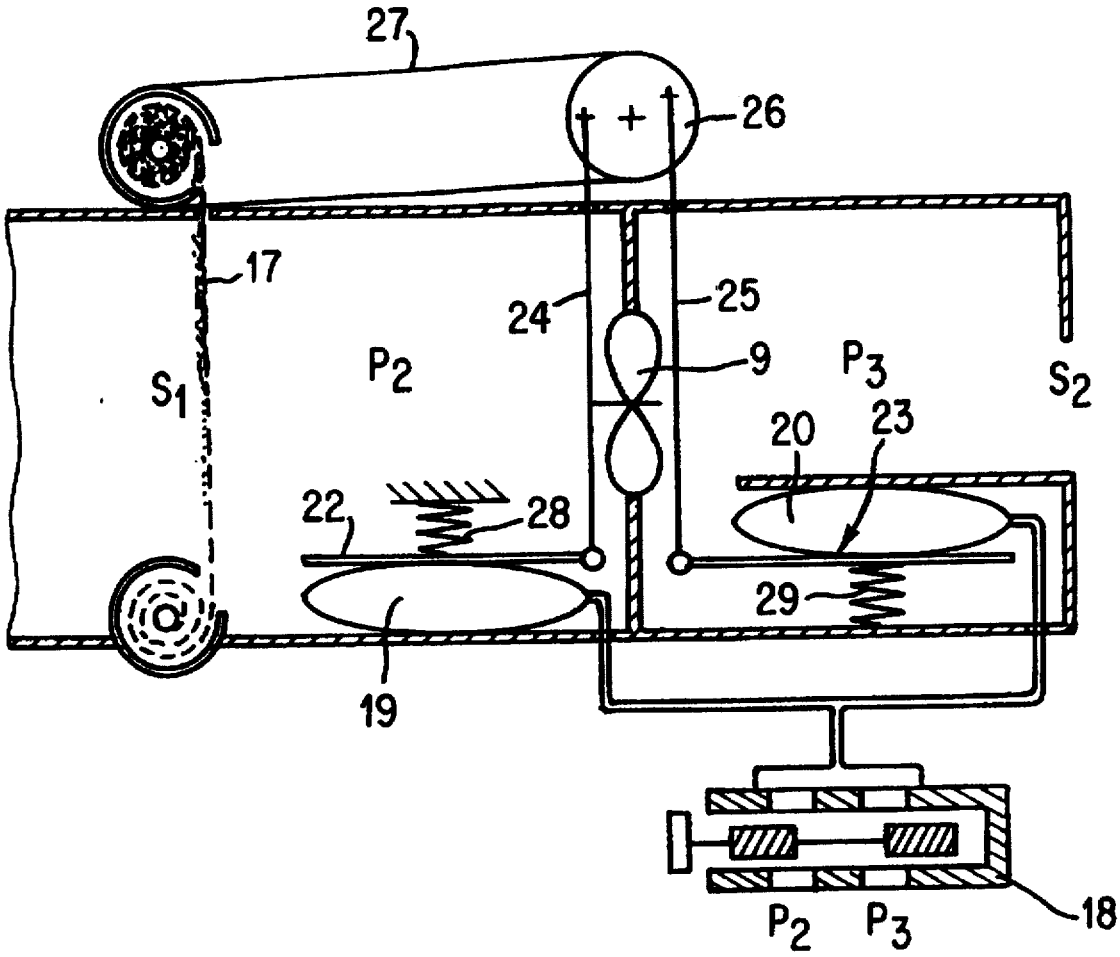
FIG. 3 is a schematic view of a part of this device, incorporating an automatic mechanism for replenishing a winding filter.

FIG. 3 represents a device according to the invention in the case of implementing a filter 17 with automatic winding. The device comprises, in this case, an all-or-nothing distributor 18 capable of sending either the pressure P2 or the pressure P3 into two bags 19 and 20. The two bags 19 and 20 bear, on the one hand, on a fixed wall and, on the other hand, on a mobile wall, 22 and 23 respectively, the walls 22 and 23 acting via two connecting rods, 24 and 25, respectively, on a disk which drives, via a freewheel mechanism 26, a cable 27 for winding the filter.

The two bags are also subjected to the action of springs, 28 and 29 respectively, which tend to oppose their inflation. When the pressure sent into the bag 19 is P2, the spring 28 exerts a force which tends to deflate this bag. If, on the other hand, it is the pressure P3 which is sent into this bag, the force exerted by the spring 28 is more than compensated for by the force developed by the pressure difference between the ambient pressure P2 and the internal pressure P3.

Inflation of the bag 19 leads to displacement of the connecting rod 24 upwards, which, via the freewheel 26, drives the cable 27 and consequently the filter 17. Similarly, when a pressure P2 is sent into the bag 20, the pressure difference between the interior and exterior allows deflation of the bag, while pressure equilibrium in and around the bag inflates it by the action of the spring 29.

The distributor 18 controlled by a deformable-wall capsule makes it possible to change the pressure sent into the bags 19 and 20 alternately from P2 to P3. The resulting movement of the mobile plates 22 and 23 is transmitted by the connecting rods 24 and 25 to the freewheel 26 which drives the filter 17.

Given that this movement is controlled by the pressures P2 and P3, it is necessary to replace the filter only when it is dirty.

As explained above, the invention provides a great improvement to the state of the art, by providing a device of simple design which makes it possible to stabilize the pressure of feeding air to the rooms of premises while providing other functions such as filtering this air, acoustic damping and, optionally, thermal treatment of the air.

I claim:

1. A method of supplying air to multiple spaces, comprising:

supplying air under a substantially stable low pressure to each of the multiple spaces with a high-pressure fan;

providing fresh and recycled air to the fan;

controlling the amount of fresh and recycled air provided to the fan based upon an air pressure differential, such that more fresh air is supplied to each of the multiple spaces when ventilation requirements of each of the multiple spaces increase, and more recycled air is supplied to each of the multiple spaces when ventilation requirements of each of the multiple spaces decrease; and operating the fan such that the fan blows air at a substantially constant flow rate;

wherein controlling the amount of fresh and recycled air provided to the fan includes activating a fresh air valve at a fresh air intake of the fan and a recycled air valve at a source of recycled air, wherein the fresh air valve and recycled air valve are activated simultaneously in opposite directions.

2. The method according to claim 1, wherein the amount of fresh and recycled air provided to the fan is controlled by monitoring a difference in air pressure between an area upstream of the fan common to both fresh and recycled air, and an area downstream of the fan yet upstream of the multiple spaces.

3. The method according to claim 2, where is the difference in pressure between the area upstream of the fan common to both fresh and recycled air, and the area downstream of the fan yet upstream of the multiple spaces is defined with respect to a reference pressure.

4. The method according to claim 3, wherein the reference pressure is based upon an air pressure outside of the multiple spaces and an air pressure within the multiple spaces.

5. The method according to claim 4, wherein the reference pressure is obtained by the formula: (A× the air pressure outside of the multiple spaces) +(B× the air pressure within the multiple spaces), wherein A is between 0.15 and 0.5 and B is between 0.5 and 0.85.

6. The method according to claim 1, further comprising arranging head-loss elements upstream and downstream of the fan in order to obtain balanced pressures at the fan and to supply air to the multiple spaces at a pressure lower than the pressure of the air provided to the fan.

7. The method according to claim 6, wherein the pressure of the air on either side of the fan, between the latter and the head-loss elements, is fixed in a range from 50 to 80 Pa.

8. The method according to claim 6, wherein the fan is operated at a pressure of between 80 and 160 Pa.

9. The method according to claim 6, wherein air is supplied to the multiple spaces at between 5 and 40 Pa.

10. A device for supplying air to multiple spaces, comprising:

an enclosure having a fresh air intake and multiple ducts connected to the multiple spaces;

a fan within the enclosure;

a fresh air valve at the fresh air intake;

a recycling pipe connecting a region adjacent the multiple outlet ducts and a region adjacent the fresh air intake; and a recycling air valve at the recycling pipe;

wherein the fresh air valve and recycling air valve are actuated simultaneously in opposite directions to supply a constant volume of air to the fan and the fan blows air at a substantially constant flow rate.

11. A device according to claim 10, further comprising a first chamber upstream of the fan and a second chamber downstream of the fan, the first chamber being bounded by a filter, and the second chamber being bounded by a wall defining an aperture, the first and second chambers generating the same head loss.

12. A device according to claim 11, wherein the wall has a cross-section equal to an equivalent cross-section of the filter when clean, less half the equivalent cross-section variation of the filter when clogged.

13. A device according to claim 12, wherein the filter is a winding filter that moves when the difference between (an air pressure in the multiple spaces—an air pressure upstream of the fan) and (an air pressure downstream of the fan—an air pressure in the multiple spaces) exceeds a predetermined value.

14. A device according to claim 13, wherein the winding filter is moved by utilizing a pressure difference between an area upstream of the fan and an area downstream of the fan without using auxiliary energy.

* * * * *